US005462404A

United States Patent [19]

Durth

[11] Patent Number: 5,462,404

[45] Date of Patent: Oct. 31, 1995

[54] ARRANGEMENT FOR AN AIR SUPPLY OF A RADIAL FAN OR BLOWER

[75] Inventor: Wilfried Durth, Landsberg/Lech, Germany

[73] Assignee: Rational GmbH, Landsberg/Lech, Germany

[21] Appl. No.: 229,304

[22] Filed: Apr. 18, 1994

[30] Foreign Application Priority Data

Apr. 20, 1993 [DE] Germany ..... 43 12 825.4

[51] Int. Cl.[6] ..... F04D 29/40

[52] U.S. Cl. ..... 415/183; 415/208.1

[58] Field of Search ..... 415/183, 208.1, 415/220, 222; 454/277, 281, 282

[56] References Cited

U.S. PATENT DOCUMENTS

| | | | |
|---|---|---|---|
| 683,447 | 10/1901 | Degge | 415/8 |
| 1,249,077 | 12/1917 | Hansley | 415/8 |
| 2,101,916 | 12/1937 | Phail | 415/183 |
| 2,211,671 | 8/1940 | Reed | 415/222 |
| 2,217,608 | 10/1940 | Atchison et al. | 415/208.1 |
| 2,984,407 | 5/1961 | McLarty | 415/208.1 |
| 4,000,955 | 1/1977 | Tokutomi | 415/183 |
| 4,182,594 | 1/1980 | Harper et al. | 415/183 |
| 4,817,300 | 4/1989 | Kramer et al. . | |

FOREIGN PATENT DOCUMENTS

| | | |
|---|---|---|
| 3209060 | 9/1983 | Germany . |
| 3217852 | 11/1983 | Germany . |
| 3503229 | 8/1986 | Germany . |
| 3701995 | 1/1987 | Germany . |
| 4004519 | 8/1990 | Germany . |

OTHER PUBLICATIONS

German Abstract of German 90 03 380, Jul. 26, 1990.

*Primary Examiner*—Edward K. Look
*Assistant Examiner*—Michael S. Lee
*Attorney, Agent, or Firm*—Hill, Steadman & Simpson

[57] ABSTRACT

An arrangement for an air supply in a radial fan or blower comprising an air guide arrangement disposed in the intake region of the fan or blower. The air guide arrangement comprises at least two baffle regions lying diametrically opposite one another and symmetrically relative to one another with respect to a plane of symmetry of the intake region that contains the rotational axis of the fan or blower, the edges of the air baffle regions neighboring the fan lying within the aperture clearance of the fan and the air baffle regions extending obliquely outward from these edges in relationship to the plane of symmetry of the intake region.

9 Claims, 2 Drawing Sheets

ARRANGEMENT FOR AN AIR SUPPLY OF A RADIAL FAN OR BLOWER

BACKGROUND OF THE INVENTION

The present invention is directed to an arrangement for an air supply of a radial fan or the like comprising an air guide means disposed in the intake area of the fan.

There are numerous proposals in the prior art regarding how an airflow in fans is to be influenced by air baffles. German DE 32 09 060 shows an air baffle in the entry region of a radial fan that is distinguished in that its upper and lower edges of the baffle are formed of graduated curves that correspond to an Archimedean spiral, wherein the lower edge is shorter than the upper edge. This arrangement or structure is intended to suppress the creation of noise. An individual control cap is also disclosed in the ventilator of German DE 35 03 229.

German DE 32 17 852 shows an air flap arrangement composed of two air flaps which are coupled to one another by a guide rod and are for different air supply regions of a radial fan. An arrangement composed of two air flaps is also disclosed by German DE 34 48 259, and this arrangement has these two flaps arranged between the pressure chamber and an intake chamber of a ventilator. The air volume stream of the ventilator can be set via these flaps. Another arrangement composed of two air guide flaps is disclosed in U.S. Pat. No. 4,817,300, which claims priority from German DE 37 01 995.

Given an air intake and discharge apparatus combination of German DE 40 04 519, three control flaps are provided, each of which can be respectively controlled by a thermostat. These control flaps are fashioned as lamellae directed transversely relative to the inflow direction of the air.

German Gebrauchsmuster 90 03 380 shows a device for climate control of a room. This device comprises an air movement means that has air guide lamellae pivotable in common within the discharge stream so that the discharge stream can be steered by movement of these air guide lamellae.

What all of these known arrangements have in common is that they essentially serve the purpose of guiding or, respectively, throttling the air stream. For some applications, by contrast, it is critical to maximize the intake flow for a fan. For example, this can be the case when it is a matter of circulating great quantities of air.

SUMMARY OF THE INVENTION

It is an object of the present invention to create an intake for an air supply in a radial fan or the like with which the flow behavior in the intake area of the fan is optimized to the effect that the intake air is taken as uniformly as possible from the volume allocated to the radial fan, for example, from the cooking chamber of a catering cooking apparatus.

An improvement of the apparatus having an air guide means disposed in the intake of a fan or blower is achieved in that the air guide means comprises at least two air baffle regions lying opposite one another and symmetrical with one another relative to a plane of an intake region which contains a rotational axis of the fan, the edges of the air baffle region adjacent the fan lie within the aperture clearance of the fan and the baffle regions extending obliquely outward from these edges in relationship to the symmetry plane of the intake region.

It can, thus, be provided that the air baffle regions are component parts of an essentially partially conical annular plate.

It can be provided in the invention that at least two separate air baffles lying essentially diametrically opposite one another are provided.

Another embodiment of the invention provides that the air baffles are arranged at an angle of incidence that preferably has the same amount but opposite operational signs.

It can thereby be provided that the air baffles are dimensioned so that the baffles extend beyond the outside circumference of the fan. It can also be provided in the invention that the air baffle regions are at such a spacing at their edges facing away from the fan and neighboring the intake regions that an enlarged intake region is available between the air baffles.

It can be additionally provided in the invention that the angle of incidence of the air baffle regions selected so that the enlarged intake volume is available between the air baffle regions.

The invention is also directed to an arrangement characterized by the fashioning and arrangement of the air baffle regions so that the effective aperture clearance of the fan is divided with approximately one-third being the central region enclosed by the air baffle regions and with approximately two-thirds being the outer two edge regions lying outside of the air guide surfaces of the baffles.

Finally, the invention is also directed to an arrangement having two essentially planar air baffles lying diametrically opposite one another, wherein the effective aperture clearance of the fan is divided with approximately one-third being the central region lying within the air baffles and the two outer side regions lying diametrically opposite one another.

It is, thus, preferably provided in the invention that the two air baffles are arranged symmetrically relative to a plane of the intake region so that the plane essentially represents a plane of symmetry of the intake region and the aperture side of the intake region is essentially swept by the air baffles at the mounting location of the baffles. What is achieved by this arrangement of air baffles proposed in conformity with the invention is that the air is also drawn into the fan from those regions of the space lying in front of the fan, particularly those regions of a cooking chamber, that are a great radial distance from the rotational axis of the fan. The effective intake region of the fan is, thus, expanded as a result whereof a more uniform intake over, for example, the cross section of the chamber will be achieved.

The air baffles conduct the air which is to be taken in and directs it to the central part of the intake region. Given an intake aperture of the fan that is generally fashioned circularly symmetrically, the proposed arrangement thereby acts regardless of the fact that the air baffles are arranged vertically, horizontally or at some other arbitrary angle with reference to one of the directions.

It is critical to the invention that the straight or curved air baffles or the air baffle ring is partially conically formed as well has its or, respectively, their edges facing toward the blower lying within the aperture clearance of the blower. What is thereby achieved is that the air can be drawn in outside the "funnel" formed by the air baffles from those volume regions of, for example, cooking chambers within which the fan is arranged, and an improved air circulation is, thus, achieved.

The air baffles are preferably arranged at an angle of incidence having the same amount but opposite operational signs. A funnel effect is thereby achieved so that the air stream is optimally guided onto the central part of the intake region.

According to an especially preferred embodiment of the invention, the air baffles are dimensioned so that they extend beyond the outside circumference of the fan.

The intake behavior is improved further when the air baffles are spaced with their edges neighboring the intake region being spaced apart so that an enlarged intake volume is available between the air baffles. The "draw-in region" of the fan, so to speak, is, thus, enlarged in comparison to a fan that does not have the baffle arrangement of the present invention.

The same effect can be achieved when the angle of incidence of the air baffles is optimally selected in this sense. A combination of the measures can be advantageous.

Other advantages and features of the invention will be readily apparent from the following description of the preferred embodiments, the drawings and claims.

DESCRIPTION OF THE PREFERRED EMBODIMENTS

Figure 1:
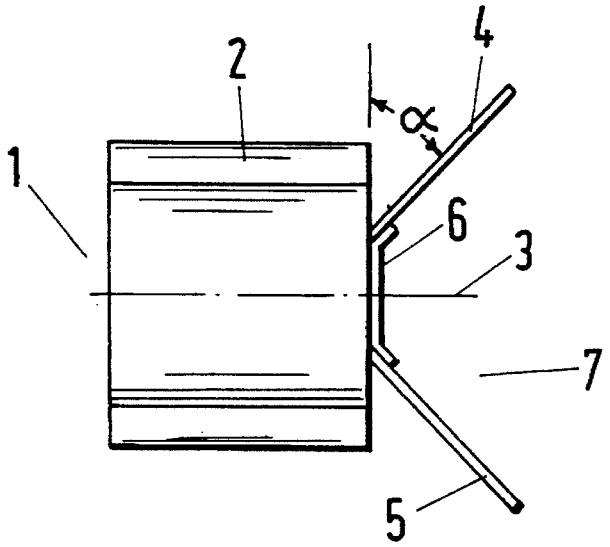
FIG. 1 is a schematic side view of a fan having the arrangement of the air baffles of the present invention.

The principles of the present invention are particularly useful when incorporated in a fan or blower 1 comprising a radial fan wheel or rotor 2, which rotates on an axis 2*a* and has means for moving air. Two air baffles 4 and 5 are arranged in the intake region 7 of the fan 1 and symmetrically relative to a plane 3 which will generally proceed through the rotational axis 2*a* (FIG. 2) of the fan 1 and divide the intake region 7 in a symmetrical way. The air baffles 4 and 5 are attached at an angle of incidence $\alpha$ (FIG. 1) whose amount is identical but whose operational sign is selected different for the respected baffles so that the air baffle 4 projects upwardly at a prescribed angle while the air baffle 5, by contrast, projects downwardly at the same angle. The air baffles 4 and 5 are attached in front of the fan by a fastening piece 6. The air baffles 4 and 5 are dimensioned so that they project upwardly or, respectively, downwardly beyond the fan 1 at least in terms of their extent. The funnel effect that is achieved with such an arrangement can be clearly seen in FIG. 1.

Figure 2:
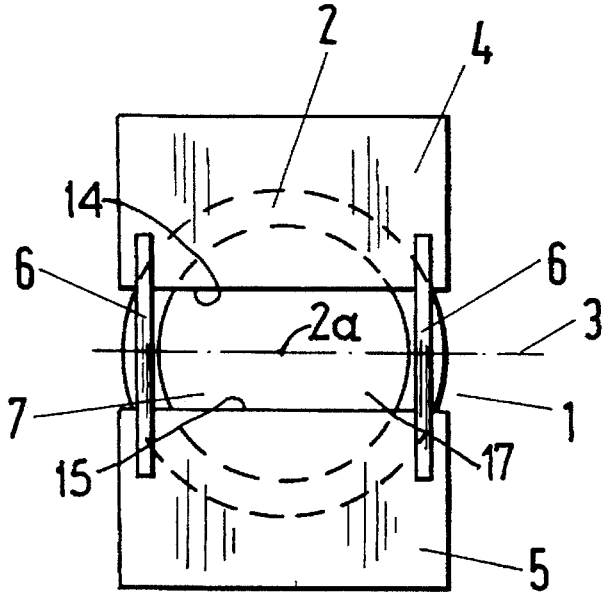
FIG. 2 is an end view taken from the right end of FIG. 1 of the fan and baffle of the present invention.

As best illustrated in FIG. 2, the two air baffles 4 and 5 are attached in front of the fan 1 and the rotor 2 with a spacing between edges 14 and 15 to form a large opening 17 over the central part of the intake region 7, i.e., the part with a large aperture clearance. Together with a suitable angle of incidence for the air baffle 4, for example an angle $\alpha$ of 45°, care can, thus, be exercised to see that a maximum intake region 7 is available from which the air is introduced into the fan or blower 1. It may also be clearly seen from this illustration that the air baffles 4 and 5, which are secured in front of the fan 1 and the rotor 2 with a fastening piece 6, project beyond the outside dimensions of the fan and rotating wheel 2 so that the intake stream remains largely separated from the discharge stream of the fan.

Figure 3:
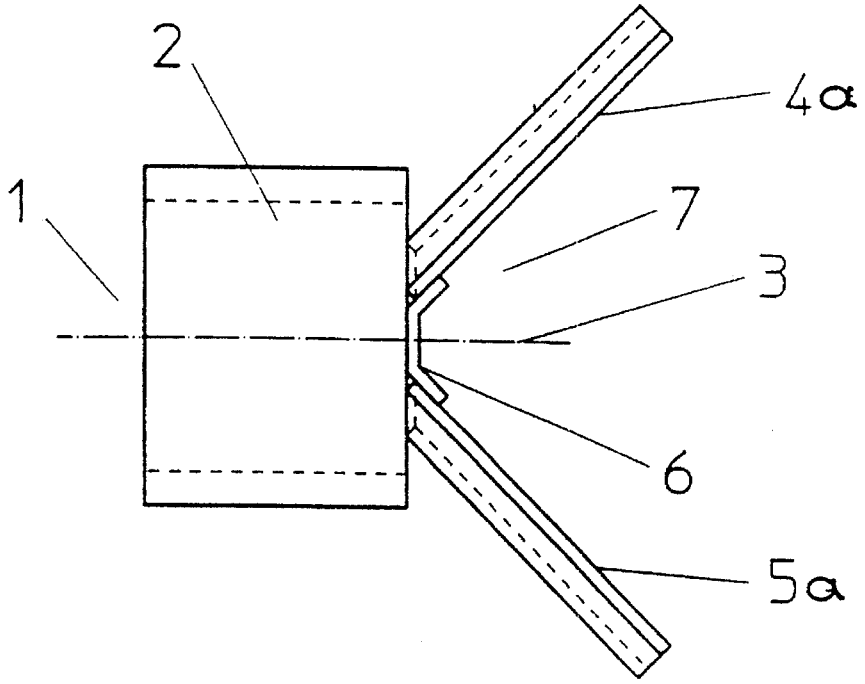
FIG. 3 is a schematic side view of a fan having a modified arrangement of the air baffles of the present invention.
Figure 4:
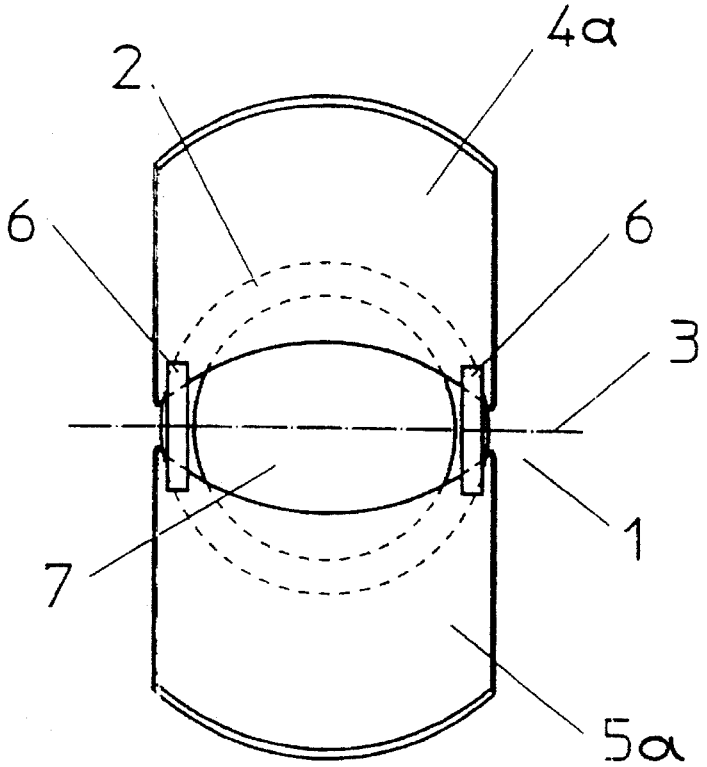
FIG. 4 is an end view of the fan and baffle taken from the right end of FIG. 3.

In FIGS. 3 and 4, a modification of the arrangement is shown. This modification has baffles 4*a* and 5*a* which are partially conically-shaped annular plates which are sections or sectors of a cone. The baffles 4*a* and 5*a* are connected together to extend at an angle to each other by pieces 6.

Although "air baffles" have been consistently mentioned in the above description, these "air baffles", of course, can be composed of some other materials besides sheet metal. For example, they can be of plastic or they can be a one-piece member which has been bent with two baffle portions separated by an opening to form, basically, a trough-shaped member.

Both individually as well as arbitrary combinations, the features of the invention disclosed in the above specification, in the drawings as well as in the claims can be critical for realizing the various embodiments of the invention Although various minor modifications may be suggested by those versed in the art, it should be understood that I wish to embody within the scope of the patent granted hereon all such modifications as reasonably and properly come within the scope of my contribution to the art.

I claim:

1. An arrangement for an air supply in a radial fan having an intake region, said arrangement comprising air guide means being disposed in the region of the fan and including two air baffle regions lying opposite one another and symmetrically relative to one another with respect to a plane of symmetry of the intake region that contains the rotational axis of the fan, said air baffle regions having edges adjacent the fan lying within the aperture clearance of the fan and said air baffle regions extending obliquely outward from these edges in relationship to the plane of symmetry of the intake region.

2. An arrangement according to claim 1, wherein the air baffle regions are component parts of an essentially partially conically shaped annular plate.

3. An arrangement according to claim 1, wherein at least two separate air baffles lying essentially diametrically opposite one another are provided.

4. An arrangement according to claim 3, wherein the air baffles are arranged at an angle of incidence having the same amount but opposite operational signs.

5. An arrangement according to claim 1, wherein the air baffle regions are air baffles which are dimensioned so as to extend beyond the outside circumference of the fan.

6. An arrangement according to claim 1, wherein the air baffle regions have their edges neighboring the intake region and facing away from the fan and the edges being spaced apart so that an enlarged intake volume is available between the air baffles.

7. An arrangement according to claim 1, wherein the angle of incidence of each of the air baffle regions is selected so that an enlarged intake region is available between the air baffle regions.

8. An arrangement according to claim 1, wherein the air baffle regions form an effective aperture clearance of the fan to be divided with approximately one-third devoted to the central region enclosed by the baffle regions and with approximately two-thirds devoted onto the edge regions lying outside of the air guide surfaces of the baffle regions.

9. An arrangement according to claim 8, wherein the two air baffle regions include air baffles that are essentially planar and lie diametrically opposite one another, the effective aperture clearance of the fan is divided with approximately, respectively, one-third to the central region lying within the air baffles and one-third devoted onto each of the two outside regions to lie diametrically opposite one another.

* * * * *